US010750277B2

(12) United States Patent
Hu et al.

(10) Patent No.: US 10,750,277 B2
(45) Date of Patent: Aug. 18, 2020

(54) METHOD, DEVICE AND SYSTEM OF LOCATING MICROPHONE

(71) Applicants: HEFEI BOE VISION-ELECTRONIC TECHNOLOGY CO., LTD., Hefei, Anhui (CN); BOE TECHNOLOGY GROUP CO., LTD., Beijing (CN)

(72) Inventors: Qianqian Hu, Beijing (CN); Chendong Xie, Beijing (CN); Weihan Li, Beijing (CN); Ya Meng, Beijing (CN)

(73) Assignees: HEFEI BOE VISION-ELECTRONIC TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/441,570

(22) Filed: Jun. 14, 2019

(65) Prior Publication Data

US 2020/0137484 A1 Apr. 30, 2020

(30) Foreign Application Priority Data

Oct. 30, 2018 (CN) ..... 2018 1 1277380

(51) Int. Cl.
*H04R 3/00* (2006.01)
*H04R 1/34* (2006.01)
(Continued)

(52) U.S. Cl.
CPC ..... *H04R 1/342* (2013.01); *H04R 1/08* (2013.01); *H04R 29/004* (2013.01)

(58) Field of Classification Search
CPC ..... H04R 1/406; H04R 19/04; H04R 1/342; H04R 29/004; H04R 11/04; H04R 17/02;
(Continued)

(56) References Cited

U.S. PATENT DOCUMENTS 9,201,521 B2 12/2015 Li et al.
10,444,401 B2 10/2019 Krapf et al.
2013/0101134 A1* 4/2013 Betts-Lacroix ..... H04S 7/30 381/80

FOREIGN PATENT DOCUMENTS

CN 1965196 A 5/2007
CN 102591254 A 7/2012
(Continued)

OTHER PUBLICATIONS

The First Chinese Office Action dated Apr. 10, 2020: Appln. No. 201811277380.8.

*Primary Examiner* — George C Monikang

(57) ABSTRACT

A method of locating a microphone, a device of locating a microphone and a system of locating a microphone. The method includes: determining an initial position of the microphone located in front of a light outgoing surface of a display screen; determining a target position of the microphone; determining a first displacement of the microphone in a direction perpendicular to the light outgoing surface of the display screen based on the target position and the initial position; determining a second displacement of the microphone in a direction parallel with the light outgoing surface of the display screen based on the target position and the initial position; and controlling the microphone to move to the target position based on the first displacement and the second displacement.

20 Claims, 4 Drawing Sheets

(51) Int. Cl.
*H04R 29/00* (2006.01)
*H04R 1/08* (2006.01)

(58) Field of Classification Search
CPC ..... H04R 19/016; H04R 21/02; H04R 9/08; H04R 29/005; G01S 3/8083; G01S 3/8006; H04S 7/303
USPC ..... 381/92, 122
See application file for complete search history.

(56) References Cited

FOREIGN PATENT DOCUMENTS

| | | | |
|---|---|---|---|
| CN | 103197600 | A | 7/2013 |
| CN | 203490506 | U | 3/2014 |
| CN | 103853097 | A | 6/2014 |
| CN | 103988134 | A | 8/2014 |
| CN | 104062626 | A | 9/2014 |
| CN | 104541235 | A | 4/2015 |
| CN | 205942403 | U | 2/2017 |
| CN | 106662666 | A | 5/2017 |

* cited by examiner

METHOD, DEVICE AND SYSTEM OF LOCATING MICROPHONE

CROSS-REFERENCE TO RELATED APPLICATION

The present application claims priority to Chinese Patent Application No. 201811277380.8, filed on Oct. 30, 2018, the disclosure of which is incorporated herein by reference in its entirety as part of the present application.

TECHNICAL FIELD

The embodiments of the present disclosure relate to a method, a device and a system of locating a microphone.

BACKGROUND

In an AQ (audio quality) test performed in TV/display industries, an acoustic test has received people's attention. During the acoustic test, in addition to special requirements, a microphone is usually required to be aligned with the central point of a screen with a distance of one meter. The position of the microphone has an influence on the result of the acoustic test, and accurately locating may eliminate the influence of the position.

SUMMARY

At least one embodiment of the present disclosure provides a method of locating a microphone, which includes:

determining an initial position of the microphone located in front of a light outgoing surface of a display screen;

determining a target position of the microphone;

determining a first displacement of the microphone in a direction perpendicular to the light outgoing surface of the display screen based on the target position and the initial position;

determining a second displacement of the microphone in a direction parallel with the light outgoing surface of the display screen based on the target position and the initial position; and controlling the microphone to move to the target position based on the first displacement and the second displacement.

For example, in the method of locating the microphone according to at least one embodiment of the present disclosure, the first displacement comprises a first movement distance and a first movement direction, and the determining the first displacement of the microphone in the direction perpendicular to the light outgoing surface of the display screen based on the target position and the initial position comprises:

determining a first perpendicular distance from the microphone to the light outgoing surface of the display screen based on the initial position;

obtaining a second perpendicular distance from the target position to the light outgoing surface of the display screen; and determining the first movement distance and the first movement direction of the microphone based on the first perpendicular distance and the second perpendicular distance.

For example, in the method of locating the microphone according to at least one embodiment of the present disclosure, the determining the first perpendicular distance from the microphone to the light outgoing surface of the display screen based on the initial position comprises:

emitting a detection signal to the light outgoing surface of the display screen from the initial position, and recording a first time point when the detection signal is emitted;

obtaining a second time point when the detection signal reflected by the light outgoing surface of the display screen is received at the initial position; and determining the first perpendicular distance based on the first time point, the second time point and a propagation velocity of the detection signal.

For example, in the method of locating the microphone according to at least one embodiment of the present disclosure, the detection signal comprises at least one selected from a group consisting of an electromagnetic wave signal and an acoustic wave signal.

For example, in the method of locating the microphone according to at least one embodiment of the present disclosure, the emitting the detection signal to the light outgoing surface of the display screen from the initial position and recording the first time point when the detection signal is emitted comprises:

emitting an acoustic wave signal to the light outgoing surface of the display screen by using an ultrasonic wave module at the initial position, and recording the first time point when the acoustic wave signal is emitted, and the obtaining the second time point when the detection signal reflected by the light outgoing surface of the display screen is received at the initial position comprises:

obtaining the second time point when the acoustic wave signal reflected by the light outgoing surface of the display screen is received by the ultrasonic wave module.

For example, in the method of locating the microphone according to at least one embodiment of the present disclosure, the second displacement comprises a second movement distance and a second movement direction, and the determining the second displacement of the microphone in the direction parallel with the light outgoing surface of the display screen based on the target position and the initial position comprises:

obtaining a first plane coordinate of a perpendicular projection point of the microphone at the initial position on a plane parallel with the light outgoing surface of the display screen;

obtaining a second plane coordinate of a perpendicular projection point of the microphone at the target position on the plane parallel with the light outgoing surface of the display screen; and determining the second movement distance and the second movement direction of the microphone based on the first plane coordinate and the second plane coordinate.

For example, in the method of locating the microphone according to at least one embodiment of the present disclosure, the plane parallel with the light outgoing surface of the display screen comprises a plane where the light outgoing surface of the display screen is located.

For example, in the method of locating the microphone according to at least one embodiment of the present disclosure, the obtaining the first plane coordinate of the perpendicular projection point of the microphone at the initial position on the plane parallel with the light outgoing surface of the display screen comprises:

determining distances from the initial position to at least two adjacent edges of the light outgoing surface of the display screen; and determining the first plane coordinate of the perpendicular projection point of the microphone at the initial position on the plane parallel with the light outgoing surface of the display screen based on the distances from the initial position to the at least two adjacent edges of the light outgoing surface of the display screen.

For example, in the method of locating the microphone according to at least one embodiment of the present disclosure, the microphone is configured to be provided with an ultrasonic wave module, and the microphone is configured to be on a rotation device, the determining the distances from the initial position to the at least two adjacent edges of the light outgoing surface of the display screen comprises:

rotating the microphone in a plurality of directions from a plane where the initial position is located by using the rotation device, and recording a rotation angle;

determining a rotation critical point corresponding to each of the plurality of directions based on the ultrasonic wave module, wherein the rotation critical point is a boundary point of the light outgoing surface of the display screen to which the ultrasonic wave module emits is capable of emitting an acoustic wave signal; and calculating the distance from the rotation critical point to the initial position, and the determining the first plane coordinate of the perpendicular projection point of the microphone at the initial position on the plane parallel with the light outgoing surface of the display screen based on the distances from the initial position to the at least two adjacent edges of the light outgoing surface of the display screen comprises:

obtaining a length and a width of the light outgoing surface of the display screen according to a set algorithm, based on the distance from the rotation critical point to the initial position and the rotation angle; and obtaining the first plane coordinate of the perpendicular projection point of the microphone at the initial position on a plane where the light outgoing surface of the display screen is located, based on the length and the width of the light outgoing surface of the display screen.

At least one embodiment of the present disclosure further provides a device of locating a microphone, which includes:

an initial position determining module, configured for determining an initial position of the microphone located in front of a light outgoing surface of a display screen;

a target position setting module, configured for determining a target position of the microphone;

a first displacement determining module, configured for determining a first displacement of the microphone in a direction perpendicular to the light outgoing surface of the display screen based on the target position and the initial position;

a second displacement determining module, configured for determining a second displacement of the microphone in a direction parallel with the light outgoing surface of the display screen based on the target position and the initial position; and a target position moving module, configured for controlling the microphone to move to the target position based on the first displacement and second displacement.

For example, in the device of locating the microphone according to at least one embodiment of the present disclosure, the first displacement comprises a first movement distance and a first movement direction, and the first displacement determining module comprises:

a perpendicular distance determining submodule, configured for determining a first perpendicular distance from the microphone to the light outgoing surface of the display screen based on the initial position;

a perpendicular distance obtaining submodule, configured for obtaining a second perpendicular distance from the target position to the light outgoing surface of the display screen; and a movement distance and direction determining submodule, configured for determining the first movement distance and the first movement direction of the microphone based on the first perpendicular distance and the second perpendicular distance.

For example, in the device of locating the microphone according to at least one embodiment of the present disclosure, the perpendicular distance determining submodule comprises:

a first time point recording submodule, configured for recording a first time point when the detection signal is emitted to the light outgoing surface of the display device from the initial position;

a second time point obtaining submodule, configured for obtaining a second time point when the detection signal reflected by the light outgoing surface of the display screen is received at the initial position; and a first perpendicular distance determining submodule, configured for determining the first perpendicular distance based on the first time point, the second time point and a propagation velocity of the acoustic wave signal.

For example, in the device of locating the microphone according to at least one embodiment of the present disclosure, the detection signal comprises at least one selected from a group consisting of an electromagnetic wave signal and an acoustic wave signal.

For example, in the device of locating the microphone according to at least one embodiment of the present disclosure, the second displacement comprises a second movement distance and a second movement direction, and the second displacement determining module comprises:

a first plane coordinate obtaining submodule, configured for obtaining a first plane coordinate of a perpendicular projection point of the microphone at the initial position on a plane parallel with the light outgoing surface of the display screen;

a second plane coordinate obtaining submodule, configured for obtaining a second plane coordinate of a point of the microphone at the target position on the plane parallel with the light outgoing surface of the display screen;

a second movement distance and direction determining submodule, configured for determining the second movement distance and the second movement direction of the microphone based on the first plane coordinate and the second plane coordinate.

For example, in the device of locating the microphone according to at least one embodiment of the present disclosure, the plane parallel with the light outgoing surface of the display screen comprises a plane where the light outgoing surface of the display screen is located.

For example, in the device of locating the microphone according to at least one embodiment of the present disclosure, the first plane coordinate obtaining submodule is configured to:

determine distances from the initial position to at least two adjacent edges of the light outgoing surface of the display screen; and determine the first plane coordinate of the perpendicular projection point of the microphone at the initial position on the plane parallel with the light outgoing surface of the display screen based on the distances from the initial position to at least two adjacent edges of the light outgoing surface of the display screen.

For example, in the device of locating the microphone according to at least one embodiment of the present disclosure, the microphone is configured to be provided thereon with an ultrasonic wave module, and the microphone is configured to be arranged on a rotation device, the first plane coordinate obtaining submodule comprises:

a rotation angle recording submodule, configured for rotating the microphone in a plurality of directions from a plane where the initial position is located by using the rotation device, and recording a rotation angle;

a rotation critical point determining submodule, configured for determining a rotation critical point corresponding to each of the plurality of directions based on the ultrasonic wave module, wherein the rotation critical point is a boundary point of the light outgoing surface of the display screen to which the ultrasonic wave module is capable of emitting an acoustic wave signal;

a distance calculating submodule, configured for calculating the distance from the rotation critical point to the initial position;

a length and width obtaining submodule, configured for obtaining a length and a width of the light outgoing surface of the display screen according to a set algorithm, based on the distance from the rotation critical point to the initial position and the rotation angle; and a first plane coordinate obtaining submodule, configured for obtaining a first plane coordinate of a perpendicular projection point of the microphone at the initial position on a plane where the light outgoing surface of the display screen is located, based on the length and the width of the light outgoing surface of the display screen.

At least one embodiment of the present disclosure further provides a device of locating a microphone, which includes:

a processor; and a storage, storing a computer program instruction which, when executed, causes the processor to execute following operations:

determining an initial position of the microphone located in front of a light outgoing surface of a display screen;

determining a target position of the microphone;

determining a first displacement of the microphone in a direction perpendicular to the light outgoing surface of the display screen based on the target position and the initial position;

determining a second displacement of the microphone in a direction parallel with the light outgoing surface of the display screen based on the target position and the initial position; and controlling the microphone to move to the target position based on the first displacement and the second displacement.

At least one embodiment of the present disclosure further provides a system of locating a microphone, which includes a device of locating a microphone as mentioned above and a detecting device, wherein the detecting device is configured to form a signal connection with the device of locating a microphone and emit the detection signal.

At least one embodiment of the present disclosure further provides a system of locating a microphone, which includes a device of locating a microphone as mentioned above and a detecting device, wherein the detecting device is configured to form a signal connection with the device of locating a microphone and emit the detection signal to determine the first displacement and the second displacement.

At least one embodiment of the present disclosure further provides a non-violate storage medium storing computer program instructions which, when executed by a processor, cause the processor to perform any of the method of detecting the microphone as mentioned above.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

In order to make the above-mentioned objects, the technical features and the advantages of the present disclosure more apparent, the present disclosure will be described in detail hereinafter in conjunction with the drawings and embodiments.

Currently, the acoustic test is usually performed manually. The manual acoustic test may have a relatively large measurement error, waste manpower resources and increase manpower resource costs.

At least one embodiment of the present disclosure provides a method and a device of locating a microphone and a system of locating a microphone, which may improve the accuracy of the acoustic test result, reduce measurement errors and lower the manpower resource costs.

Figure 1:
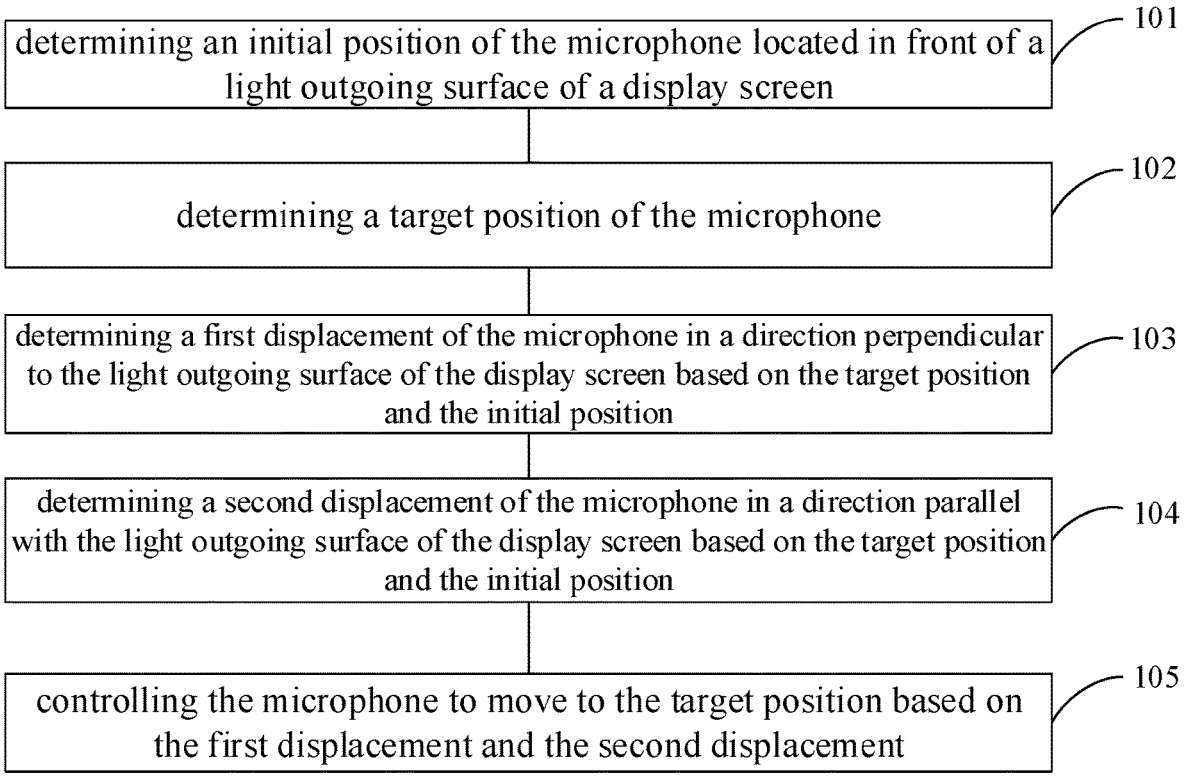
FIG. 1 is a flow chart of a method of locating a microphone according to at least one embodiment of the present disclosure.

FIG. 1 is a flow chart of a method of locating a microphone according to at least one embodiment of the present disclosure. The method includes the following steps.

Step 101: determining an initial position of the microphone in front of a light outgoing surface of a display screen.

The embodiments of the present disclosure may be applied to a scenario of locating the microphone before an AQ test performed on an electronic device such as a TV, a display or the like.

During the AQ test on the electronic device such as a TV, a display or the like, the microphone may be arranged in front of the light outgoing surface of the display screen of the electronic device such as the TV, display or the like firstly, and the microphone may pointed to any position of the light outgoing surface of the display screen, and the embodiments of the present disclosure are not limited thereto.

After the microphone is arranged in front of the light outgoing surface of the display screen, the current location of the microphone, i.e., an initial position, may be obtained according to a certain rule. For example, a lower left corner of the light outgoing surface of the display screen may be taken as an origin of coordinates, a height of the display screen is used as a y axis, and a width of the display screen is used as an x axis, thereby calculating a perpendicular distance from the microphone to the light outgoing surface of the display screen, and calculating the coordinates of the position of the microphone, so as to determine the initial position of the microphone.

Certainly, in specific implementations, persons skilled in the art may adopt other methods to obtain the initial position of the microphone, and the embodiments of the present disclosure are not limited thereto.

Step 102: determining a target position of the microphone.

The target position may be the position where the microphone is located during the AQ test, i.e., a standard position for the AQ test.

It should be understood that the target position of the microphone may be set by a research personnel based on actual conditions, and the embodiments of the present disclosure have no limitation on the target position, for example, a distance to the light outgoing surface of the display screen. For example, in some embodiments, step 102 may include: setting the target position of the microphone.

Step 103: determining a first displacement of the microphone in a direction perpendicular to the light outgoing surface of the display screen based on the target position and the initial position.

In the embodiments of the present disclosure, the first displacement refers to the required displacement of the microphone in one or more directions perpendicular to the light outgoing surface of the display screen, for example, to move by 4 cm close to the light outgoing surface of the display screen, or to move by 7 cm away from the light outgoing surface of the display screen, or the like.

After the target position and the initial position of the microphone are obtained, the first displacement of the microphone in the direction perpendicular to the light outgoing surface may be calculated based on the target position and the initial position, and the process of calculating the first displacement will be described in detail in the following embodiments, and is not repeated here in the embodiment of the present disclosure.

Step 104: determining a second displacement of the microphone in a direction parallel with the light outgoing surface of the display screen based on the target position and the initial position.

In the embodiments of the present disclosure, the second displacement refers to the required moving distance and the direction of the microphone in one or more directions parallel with the light outgoing surface of the display screen, for example, to move by 5 cm leftwards, or to move by 6 cm rightwards, or the like, and the embodiments of the present disclosure are not limited thereto.

After the target position and the initial position of the microphone are obtained, the second displacement of the microphone in the direction parallel with the light outgoing surface may be calculated based on coordinates of the target position and the initial position, and the process of calculating the second displacement will be described in detail in the following second embodiment, and is not repeated here in the embodiment of the present disclosure.

After the first and second displacements are determined, step 105 is performed.

Step 105: controlling the microphone to move to the target position, based on the first and second displacements.

After the first and second displacements are obtained, the microphone may be controlled to move according to the first and second displacements, thereby moving the microphone to the target position and achieving locating the microphone. For example, the first displacement is to move by 5 cm towards the light outgoing surface of the display screen, and the second displacement is to move by 3 cm leftwards in a plane parallel with the light outgoing surface of the display screen, or the like, thereby controlling the microphone to move by prescribed distances in different directions successively based on the first and second displacements to achieve locating the microphone.

In the embodiments of the present disclosure, a position setting module, a support and a MCU (Micro Control Unit) module may also be provided in advance. An motor may be arranged in the support in advance, the support has a function of scaling up and down and moving left and right, and the motor may provide kinetic energy for the up-down scaling and left-right moving of the support. The position setting module may set the target position of the microphone, and the MCU module may calculate the distance, perform data analysis and control the operation of the motor in the support to control the support to move up and down as well as left and right, so as to locate the microphone.

Certainly, in specific implementations, persons skilled in the art may adopt other methods to locate the microphone, and the embodiments of the present disclosure are not limited thereto.

In the method of locating a microphone according to the embodiments of the present disclosure, by determining the initial position of the microphone in front of the light outgoing surface of the display screen, determining the target position of the microphone, determining the first displacement of the microphone in the direction perpendicular to the light outgoing surface of the display screen based on the target position and the initial position, determining the second displacement of the microphone in the direction parallel with the light outgoing surface of the display screen based on the target position and the initial position, and controlling the microphone to move to the target position based on the first and second displacements, the accuracy of the acoustic test result may be improved, the measurement errors may be reduced and manpower resource costs may be lowered.

Figure 2:
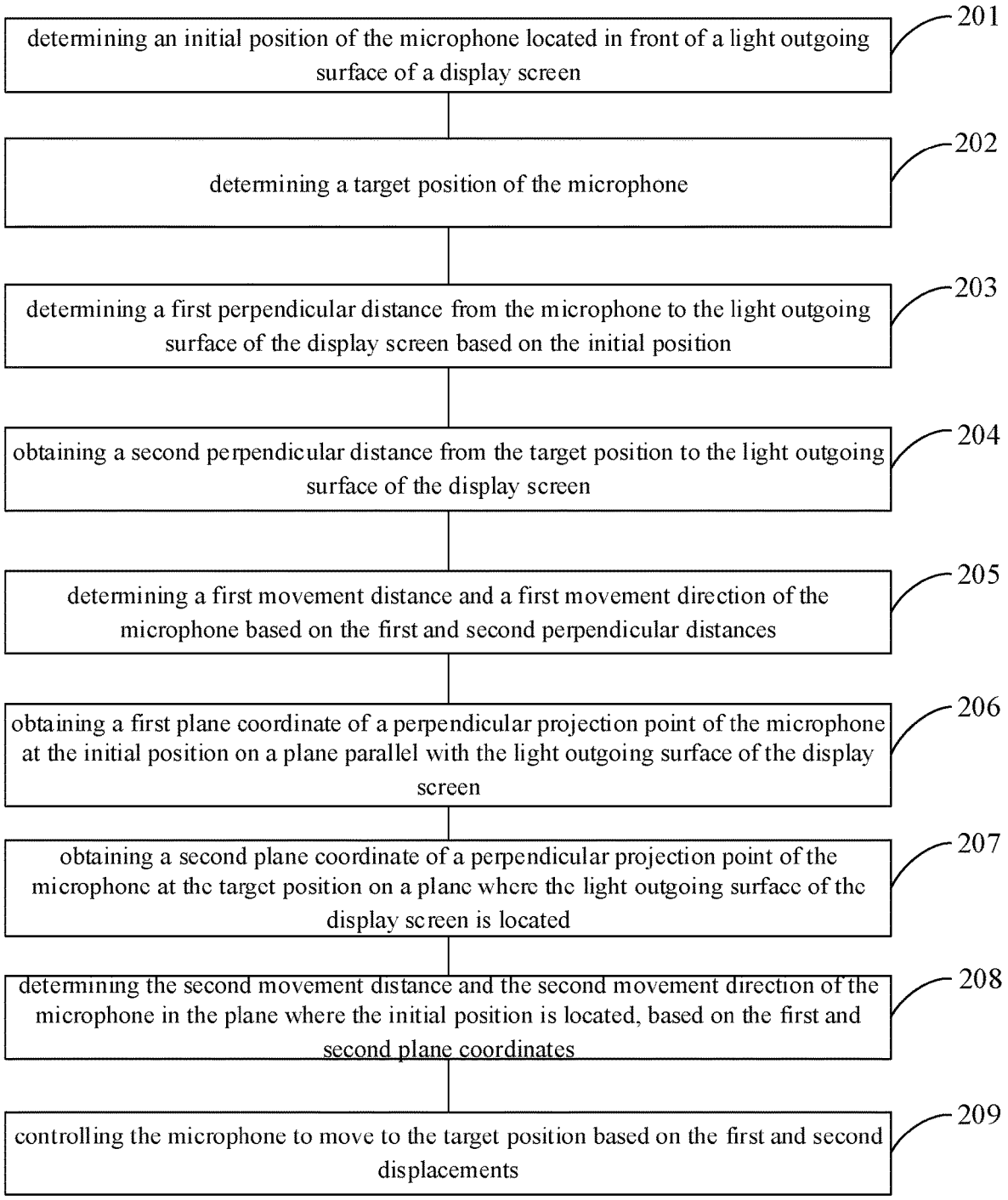
FIG. 2 is a flow chart of a method of locating a microphone according to at least one embodiment of the present disclosure.

FIG. 2 is a flow chart of a method of locating a microphone according to at least one embodiment of the present disclosure. The method includes the following steps.

Step 201: determining an initial position of the microphone located in front of a light outgoing surface of a display screen.

The embodiments of the present disclosure may be applied to a scenario of locating the microphone before an AQ test performed on an electronic device such as a TV, a display or the like.

During the AQ test on the electronic device such as a TV, a display or the like, the microphone may be arranged in front of the light outgoing surface of the display screen of the electronic device such as the TV, display or the like firstly, and the microphone may face any position of the light outgoing surface of the display screen, and the embodiments of the present disclosure have no limitation in this aspect.

After the microphone is arranged in front of the light outgoing surface of the display screen, the current location of the microphone, i.e., an initial position, may be obtained according to a certain rule. For example, a lower left corner of the light outgoing surface of the display screen may be taken as an origin of coordinates, a height of the display screen is used a y axis, and a width of the display screen is used an x axis, thereby calculating a perpendicular distance from the microphone to the light outgoing surface of the display screen, and calculating the coordinates of the position of the microphone, so as to determine the initial position of the microphone.

Certainly, in specific implementations, persons skilled in the art may adopt other methods to obtain the initial position of the microphone, and the embodiments of the present disclosure have no limitation in this aspect.

Step 202: determining a target position of the microphone.

The target position may be the position where the microphone is located during the AQ test, i.e., a standard position for the AQ test.

It should be understood that the target position of the microphone is set by a research personnel based on actual conditions, and the embodiments of the present disclosure have no limitation on the target position of the microphone, for example, a distance to the light outgoing surface of the display screen. For example, in some embodiments, the step 202 may include: setting the target position of the microphone.

Step 203: determining a first perpendicular distance from the microphone to the light outgoing surface of the display screen based on the initial position.

In the embodiments of the present disclosure, the first perpendicular distance refers to a length of a connection line segment between the microphone and the light outgoing surface of the display screen perpendicular to the light outgoing surface of the display screen. For example, a detection signal may be emitted to the light outgoing surface of the display screen, and the first perpendicular distance may be obtained by transmitting and receiving the detection signal. In some embodiments, an acoustic wave signal may be emitted to the light outgoing surface of the display screen by an ultrasonic wave module, and the first perpendicular distance is obtained by transmitting and receiving the acoustic wave signal, which will be described in detail in the following embodiments.

In an exemplary embodiment of the embodiments of the present disclosure, the microphone is provided thereon with the ultrasonic wave module, and the above-mentioned step 203 may include the following substeps.

Substep S1: emitting an acoustic wave signal to the light outgoing surface of the display screen using the ultrasonic wave module, and recording a first time point when the acoustic wave signal is emitted.

In some embodiments of the present disclosure, when the first perpendicular distance is calculated, the acoustic wave signal may be emitted to the light outgoing surface of the display screen by the ultrasonic wave module arranged on the microphone, and the first time point when the ultrasonic wave module emits the acoustic wave signal is recorded, and then the substep S2 is performed.

Substep S2: obtaining a second time point when the acoustic wave signal reflected by the light outgoing surface of the display screen is received by the ultrasonic wave module. In some embodiments, the acoustic wave signal may be emitted and received by different ultrasonic wave modules, and the embodiments of the present disclosure have no limitation in this aspect.

After the light outgoing surface of the display screen receives the acoustic wave signal, the light outgoing surface may reflect this acoustic wave signal to the microphone based on the reflection characteristics of the acoustic wave. In the system, the microphone receives the reflected acoustic wave signal, which may be monitored in real time, and the corresponding second time point may be recorded, and then substep S3 is performed.

Substep S3: determining the first perpendicular distance based on the first time point, the second time point and a propagation velocity of the acoustic wave signal.

Upon obtaining the first time point when the ultrasonic wave module arranged in the microphone emits the acoustic wave signal and the second time point corresponding to the reception of the acoustic wave signal reflected by the light outgoing surface of the display screen, the first perpendicular distance is calculated based on the propagation velocity of the acoustic wave signal.

$$\text{For example, } S=340*t/2 \quad (1).$$

In the above-mentioned formula (1), S represents the first perpendicular distance from the microphone to the light outgoing surface of the display screen, t represents the time from the emission of the acoustic wave signal to the reception of the reflected acoustic wave signal, that is a difference value between the second time point and the first time point, and 340 represents the propagation velocity of the acoustic wave signal in the air.

The first perpendicular distance may be calculated based on the first time point, the second time point and the propagation velocity of the acoustic wave signal.

However, it should be understood that the above-mentioned acoustic wave signal is only an example of the detection signal. In other embodiments, the first perpendicular distance may also be determined by an electromagnetic wave signal or a combination of the electromagnetic wave signal and the acoustic wave signal, and the embodiments of the present disclosure have no limitation in this aspect.

Certainly, in specific implementations, persons skilled in the art may also adopt other methods to obtain the first perpendicular distance. For example, after the initial position of the microphone is obtained, a coordinate of a point corresponding to an orthographic projection of the microphone at the initial position on the light outgoing surface of the display screen (that is, the connection line between the position point of the microphone and the projection point is perpendicular to the light outgoing surface of the display screen) is obtained based on the coordinate of the initial position. The first perpendicular distance from the microphone to the light outgoing surface of the display screen may be calculated based on the coordinates of the initial position and the projection point, for example. The coordinate of the initial position of the microphone is (0, 0, 0), and the coordinate of the projection point is (0, 0, 5) in centimeters, and the first perpendicular distance may be calculated as 5 cm.

It should be understood that the above-mentioned example is merely provided in order to better understand the technical solution of the embodiments of the present disclosure, and is not only limitation to the embodiments of the present disclosure.

In practical applications, persons skilled in the art may select the method of obtaining the first perpendicular distance as required, and the embodiments of the present disclosure have no limitation in this aspect.

Step 204: obtaining a second perpendicular distance from the target position to the light outgoing surface of the display screen.

After the target position is set, a coordinate of a point corresponding to an orthographic projection on the light outgoing surface of the display screen at the target position (that is, the connection line between the target position and a projection point is perpendicular to the light outgoing surface of the display screen) may be obtained based on a coordinate of the target position. The second perpendicular distance from the target position to the light outgoing surface of the display screen may be calculated based on the coordinates of the target position and the projection point, for example, the coordinate of the target position is (0, 0, 0) in centimeters, and the coordinate of the projection point is (0, 0, 8) in centimeters, and the second perpendicular distance may be calculated as 8 cm.

It should be understood that the above-mentioned example is merely provided in order to better understand the technical solution of the embodiments of the present disclosure, and is not limitative of the embodiments of the present disclosure.

In practical applications, persons skilled in the art may obtain the second perpendicular distance by other methods, and the embodiments of the present disclosure are not limited thereto. For example, in some embodiments, the second perpendicular distance from the target position to the light outgoing surface of the display screen may also be obtained by a method similar to the above-mentioned method of determining the first perpendicular distance.

Step 205: determining a first movement distance and a first movement direction of the microphone, based on the first and second perpendicular distances.

After the first and second perpendicular distances are obtained, the first movement distance and the first movement direction (i.e., the first displacement) of the microphone may be determined. For example, if the first perpendicular distance is 5 cm, and the second perpendicular distance is 8 cm, the first movement distance may be determined to be 3 cm, and the first movement direction is away from the light outgoing surface of the display screen.

It should be understood that the above-mentioned example is merely provided in order to better understand the technical solution of the embodiments of the present disclosure, and is not limitative of the embodiments of the present disclosure.

Step 206: obtaining a first plane coordinate of a perpendicular projection point of the microphone at the initial position on a plane parallel with the light outgoing surface of the display screen.

The first plane coordinate refers to the plane coordinate of the perpendicular projection point of the microphone at the initial position on a plane parallel with the light outgoing surface of the display screen. The plane parallel with the light outgoing surface of the display screen, for example, may be the plane where the light outgoing surface of the display screen is located.

Firstly, the perpendicular projection point of the microphone at the initial position on the plane where the light outgoing surface of the display screen is located may be obtained. Further, a vertex at the lower left corner of the light outgoing surface of the display screen may be taken as an origin of plane coordinates, and a plane coordinate corresponding to each vertex of the light outgoing surface is obtained based on a length and width of the light outgoing surface of the display screen, thereby calculating the plane coordinate of the perpendicular projection point of the microphone at the initial position on the plane where the light outgoing surface of the display screen is located, i.e., the first plane coordinate.

The specific implementation of obtaining the first plane coordinate will be described in detail in the following embodiments.

In some embodiments, the step 206 may include:

determining a distance from the initial position to at least two adjacent edges of the light outgoing surface of the display screen; and determining the first plane coordinate of the perpendicular projection point of the microphone at the initial position on the plane parallel with the light outgoing surface of the display screen based on the distance from the initial position to at least two adjacent edges of the light outgoing surface of the display screen.

For example, in the case where the light outgoing surface of the display screen is rectangular, and the vertex at the lower left corner of the light outgoing surface of the display screen is taken as the origin of plane coordinates, the distances from the initial position to the left and right edges of the light outgoing surface of the display screen may be determined respectively, and may be taken as an abscissa and an ordinate of the perpendicular projection point of the microphone at the initial position on the plane parallel with the light outgoing surface of the display screen respectively, wherein the abscissa and the ordinate form the first plane coordinate.

In an exemplary embodiment of the embodiments of the present disclosure, the above-mentioned step 206 may include the following substeps.

Substep A1: rotating the microphone in various directions from the plane where the initial position is located using the rotation device, and recording the rotation angles.

In the embodiments of the present disclosure, the rotation device may be arranged in advance and fixed on the support, and the microphone is arranged on the rotation device.

The rotation device may rotate and record the rotation angle. During the process of determining a boundary of the light outgoing surface of the display screen, the rotation device may be controlled to rotate, and the rotation angle may be recorded.

Substep A2: determining a rotation critical point corresponding to each direction based on the ultrasonic wave module.

In the embodiments of the present disclosure, the rotation critical point refers to a boundary point of the light outgoing surface of the display screen to which the ultrasonic wave module is capable of emitting the acoustic wave signal.

Since the acoustic wave signal emitted by the ultrasonic wave module travels straightly, during the process of controlling the rotation device, the ultrasonic wave module may be controlled to emit the acoustic wave signal to the light outgoing surface of the display screen. In the case where there is a wall surface of other obstacles behind the display screen and the ultrasonic wave module rotates at a constant speed up and down as well as left and right to emit the acoustic wave signal, if the acoustic wave signal reflected by the light outgoing surface of the display screen is still received, the distance must meet a certain regular curvilinear path, and if the acoustic wave signal reflected by the wall or other obstacles behind the display screen is received, the distance does not meet the regular curvilinear path, and it is determined that the boundary point is reached.

In specific implementations, the rotation device may be controlled to move in four corresponding directions, i.e., up, down, left and right, of the light outgoing surface of the display screen, and to determine the rotation critical point in each direction in combination with the ultrasonic wave module, and then the substep A3 is performed.

Substep A3: calculating the distance from the rotation critical point to the initial position.

In the embodiments of the present disclosure, the following description will be made with respect to four directions of the light outgoing surface of the display screen, i.e., up, down, left and right.

(1) When the rotation device is controlled to rotate to the left side of the light outgoing surface of the display screen, in the case where it is judged through the ultrasonic wave module that the distance is just out of the range, the rotation angle of the rotation device at this point is recorded, and a real-time distance measured when the ultrasonic wave module rotates leftwards, i.e., the distance from the initial position to the leftmost end of the light outgoing surface of the display screen, thereby calculating the horizontal distance from the initial position of the microphone to a leftmost end of the light outgoing surface of the display screen according to the following formula (1).

$$L_1=S_1*\sin\alpha \quad (1)$$

In the above-mentioned formula, $L_1$ represents the horizontal distance from the initial position to the leftmost end of the light outgoing surface of the display screen, $S_1$ represents the real-time distance measured when the ultrasonic wave module rotates leftwards, and $\alpha$ represents the rotation angle by which the rotation device rotates leftwards.

According to the above-mentioned formula (1), the horizontal distance from the initial position of the microphone to the leftmost end of the light outgoing surface of the display screen may be calculated.

(2) When the rotation device is controlled to rotate to the right side of the light outgoing surface of the display screen, in the case where it is judged through the ultrasonic wave module that the distance is just out of the range, the rotation angle of the rotation device at this point is recorded, and a real-time distance measured when the ultrasonic wave module rotates rightwards, i.e., the distance from the initial position to the rightmost end of the light outgoing surface of the display screen, thereby calculating the horizontal distance from the initial position of the microphone to a rightmost end of the light outgoing surface of the display screen according to the following formula (2).

$$L_2=S_2*\sin\beta \quad (2)$$

In the above-mentioned formula, $L_2$ represents the horizontal distance from the initial position to the rightmost end of the light outgoing surface of the display screen, $S_2$ represents the real-time distance measured when the ultrasonic wave module rotates rightwards, and $\beta$ represents the rotation angle by which the rotation device rotates rightwards.

According to the above-mentioned formula (2), the horizontal distance from the initial position of the microphone to the rightmost end of the light outgoing surface of the display screen may be calculated.

(3) When the rotation device is controlled to rotate to the upper side of the light outgoing surface of the display screen, in the case where it is judged through the ultrasonic wave module that the distance is just out of the range, the rotation angle of the rotation device at this point is recorded, and a real-time distance measured when the ultrasonic wave module rotates upwards, i.e., the distance from the initial position of the microphone to the uppermost end of the light outgoing surface of the display screen, thereby calculating the horizontal distance from the initial position of the microphone to the uppermost end of the light outgoing surface of the display screen according to the following formula (3).

$$L_3=S_3*\sin\gamma \quad (3)$$

In the above-mentioned formula, $L_3$ represents the horizontal distance from the initial position to the uppermost end of the light outgoing surface of the display screen, $S_3$ represents the real-time distance measured when the ultrasonic wave module rotates upwards, and $\gamma$ represents the rotation angle by which the rotation device rotates upwards.

According to the above-mentioned formula (3), the horizontal distance from the initial position of the microphone to the uppermost end of the light outgoing surface of the display screen may be calculated.

(4) When the rotation device is controlled to rotate to the lower side of the light outgoing surface of the display screen, in the case where it is judged through the ultrasonic wave module that the distance is just out of the range, the rotation angle of the rotation device at this point is recorded, and a real-time distance measured when the ultrasonic wave module rotates downwards, i.e., the distance from the initial position of the microphone to the lowermost end of the light outgoing surface of the display screen, thereby calculating the horizontal distance from the initial position of the microphone to the lowermost end of the light outgoing surface of the display screen according to the following formula (4).

$$L_4=_4*\sin\theta \quad (4)$$

In the above-mentioned formula, $L_4$ represents the horizontal distance from the initial position to the lowermost end of the light outgoing surface of the display screen, $S_4$ represents the real-time distance measured when the ultrasonic wave module rotates downwards, and $\theta$ represents the rotation angle by which the rotation device rotates downwards.

According to the above-mentioned formula (4), the horizontal distance from the initial position of the microphone to the lowermost end of the light outgoing surface of the display screen may be calculated.

In combination with the above-mentioned four solutions, the rotation critical point in each direction of the rotation device may be determined, and then the following substep A4 is performed.

Substep A4: obtaining the length and width of the light outgoing surface of the display screen according to a set algorithm, based on each of the distances and each of the rotation angles.

After the rotation angle of the rotation device in each direction and the distance from each rotation critical point to the initial position are obtained, based on each distance and each rotating angle, the length and width of the light outgoing surface of the display screen are calculated according to the set algorithm. That is, after the distance from the boundary of the light outgoing surface of the display screen in each direction to the initial position is calculated based on the formulas (1), (2), (3) and (4) in the above-mentioned substep A3, the horizontal distances are added to obtain the width/length of the light outgoing surface of the display screen, and the vertical distances are added to obtain the length/width of the light outgoing surface of the display screen.

Substep A5: determining a first plane coordinate of a perpendicular projection point of the microphone at the initial position on a plane where the light outgoing surface of the display screen is located, based on the length and width of the light outgoing surface of the display screen.

After the length and width of the light outgoing surface of the display screen are obtained, a certain vertex of the light outgoing surface of the display screen is taken as the origin of coordinates, to establish a plane coordinate system, and the first plane coordinate corresponding to the initial position in the plane coordinate system is calculated based on the distance from the initial position of the microphone to the boundary in each direction.

It should be understood that the above-mentioned example is merely provided in order to better understand the technical solution of the embodiments of the present disclosure, and is not limitative of the embodiments of the present disclosure.

In practical applications, persons skilled in the art may obtain the first plane coordinate using other methods, and the embodiments of the present disclosure are not limited thereto.

Step 207: obtaining a second plane coordinate of a perpendicular projection point of the microphone at the target position on a plane where the light outgoing surface of the display screen is located.

The second plane coordinate refers to the plane coordinate of a perpendicular projection point of the microphone at the target position on the plane where the light outgoing surface of the display screen is located.

Firstly, the perpendicular projection point of the microphone at the target position on the plane where the light outgoing surface of the display screen is located may be obtained. Further, a vertex at the lower left corner of the light outgoing surface of the display screen may be taken as an origin of plane coordinates, and a plane coordinate corresponding to each vertex of the light outgoing surface is obtained based on a length and width of the light outgoing surface of the display screen, thereby calculating the plane coordinate of the perpendicular projection point of the microphone at the target position on the plane where the light outgoing surface of the display screen is located, i.e., the second plane coordinate.

In specific implementations, persons skilled in the art may obtain the second plane coordinate using other methods, and the embodiments of the present disclosure are not limited thereto.

Step 208: determining a second movement distance and a second movement direction of the microphone in the plane where the initial position is located, based on the first and second plane coordinates.

After the first and second plane coordinates are obtained, the second movement direction and the second movement distance of the microphone in the plane where the initial position is located may be obtained based on the first and second plane coordinates, wherein the plane where the initial position is located is parallel with the light outgoing surface of the display screen.

For example, if the first plane coordinate is (0, 3) in centimeters, and the second plane coordinate is (0, 5) in centimeters, the second movement distance may be calculated to be 2 cm, and the second movement direction is the direction of y axis, or the like.

It should be understood that the above-mentioned example is merely provided in order to better understand the technical solution of the embodiments of the present disclosure, and is not limitative of the embodiments of the present disclosure.

Step 209: controlling the microphone to move to the target position based on the first and second displacements.

In the embodiments of the present disclosure, the first displacement may include the first movement distance and the first movement direction, and the second displacement may include the second movement distance and the second movement direction. After the first movement distance and the first movement direction as well as the second movement distance and the second movement direction are obtained, the microphone may be controlled to move in the first movement direction by the first movement distance, and to move in the second movement direction by the second movement distance, thereby achieving locating the microphone.

Certainly, the microphone may also be controlled to move in the second movement direction by the second movement distance first, and then to move in the first movement direction by the first movement distance, thereby achieving locating the microphone.

It should be understood that the locating of the microphone may be finished in any movement manner, and the movement control is not limited in the embodiments of the present disclosure.

In the method of locating a microphone according to the embodiments of the present disclosure, by determining the initial position of the microphone in front of the light outgoing surface of the display screen, setting the target position of the microphone, determining the first displacement of the microphone in the direction perpendicular to the light outgoing surface of the display screen based on the target position and the initial position, determining the second displacement of the microphone in the direction parallel with the light outgoing surface of the display screen based on the target position and the initial position, and controlling the microphone to move to the target position based on the first and second displacements, the accuracy of the acoustic test result may be improved, the measurement errors may be reduced and manpower resource costs may be lowered.

Figure 3:
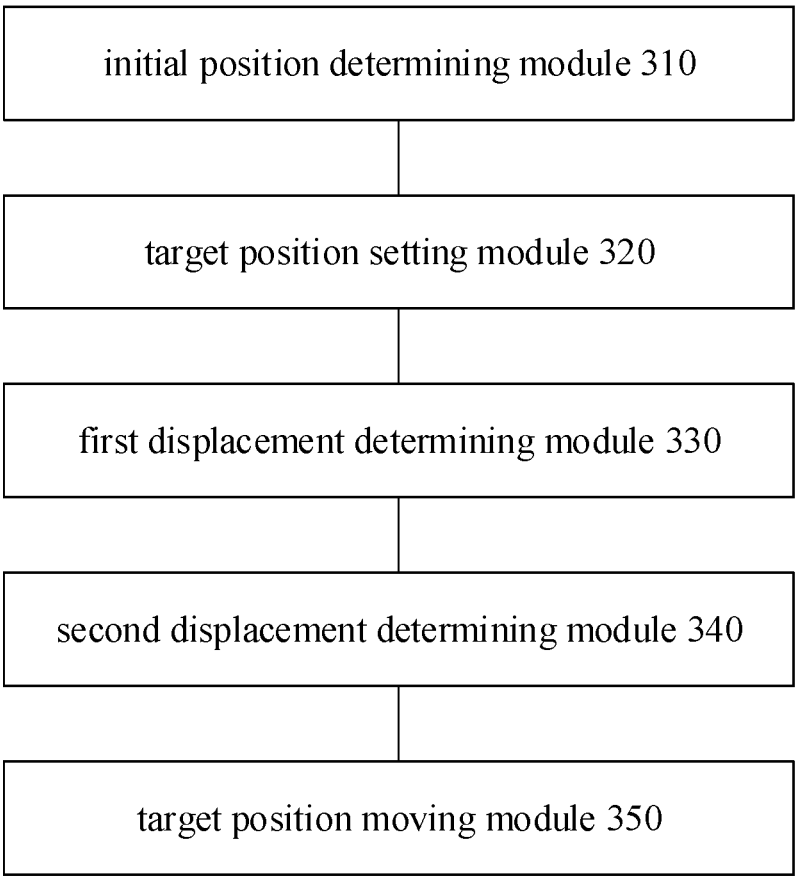
FIG. 3 is a schematic structural diagram of a device of locating a microphone according to at least one embodiment of the present disclosure.

FIG. 3 is a schematic structural diagram of a device of locating a microphone according to at least one embodiment of the present disclosure. The device of locating a microphone may include: an initial position determining module 310 configured for determining an initial position of the microphone located in front of a light outgoing surface of a display screen; a target position setting module 320 configured for determining a target position of the microphone; a first displacement determining module 330 configured for determining a first displacement of the microphone in a direction perpendicular to the light outgoing surface of the display screen based on the target position and the initial position; a second displacement determining module 340 configured for determining a second displacement of the microphone in a direction parallel with the light outgoing surface of the display screen based on the target position and the initial position; and a target position moving module 350 configured for controlling the microphone to move to the target position based on the first and second displacements.

In some embodiments, the first displacement determining module 330 may include: a perpendicular distance determining submodule configured for determining a first perpendicular distance from the microphone to the light outgoing surface of the display screen based on the initial position; a perpendicular distance obtaining submodule configured for obtaining a second perpendicular distance from the target position to the light outgoing surface of the display screen; a movement distance and direction determining submodule configured for determining the first movement distance and the first movement direction of the microphone based on the first and second perpendicular distances.

In some embodiments, the perpendicular distance determining submodule may include: a first time point recording submodule configured for recording a first time point when the detection signal is emitted to the light outgoing surface of the display device from the initial position; a second time point obtaining submodule configured for obtaining a second time point when the detection signal reflected by the light outgoing surface of the display screen is received at the initial position; a first perpendicular distance determining submodule configured for determining the first perpendicular distance based on the first time point, the second time point and the propagation velocity of the acoustic wave signal. For example, in some embodiments, the first time point recording submodule may be configured to use the ultrasonic wave module to emit the acoustic wave signal to the light outgoing surface of the display screen, and to record the first time point of emitting the acoustic wave signal, and the second time point obtaining submodule may be configured to obtain the second time point when the ultrasonic wave module receives the acoustic wave signal reflected by the light outgoing surface of the display screen, and the embodiments of the present disclosure are not limited thereto.

In some embodiments, for example, the perpendicular distance determining submodule may be implemented as an ultrasonic wave distance sensor. However, it should be understood that it is not limited in the embodiments of the present disclosure.

It should be understood that the above-mentioned acoustic wave signal is only one example of the detection signal. In other embodiments, the first perpendicular distance may also be determined by an electromagnetic wave signal or a combination of the electromagnetic wave signal and the acoustic wave signal, and the embodiments of the present disclosure are not limited thereto.

In some embodiments, the second displacement determining module 340 may include: a first plane coordinate obtaining submodule configured for obtaining a first plane coordinate of a perpendicular projection point of the microphone at the initial position on a plane parallel with the light outgoing surface of the display screen; a second plane coordinate obtaining submodule configured for obtaining a second plane coordinate of a perpendicular projection point of the microphone at the target position on a plane parallel with the light outgoing surface of the display screen; a second movement distance and direction determining submodule configured for determining the second movement distance and the second movement direction of the microphone based on the first and second plane coordinates. For example, the plane parallel with the light outgoing surface of the display screen may include the plane where the light outgoing surface of the display screen is located.

In some embodiments, the first plane coordinate obtaining submodule is configured to: determine a distance from the initial position to at least two adjacent edges of the light outgoing surface of the display screen; and determine the first plane coordinate of the perpendicular projection point of the microphone at the initial position on the plane parallel with the light outgoing surface of the display screen based on the distance from the initial position to at least two adjacent edges of the light outgoing surface of the display screen.

In some embodiments, the first plane coordinate obtaining submodule may include: a rotation angle recording submodule configured for rotating the microphone in various directions from the plane where the initial position is located by using the rotation device, and recording a rotation angle; a rotation critical point determining submodule configured for determining a rotation critical point corresponding to each direction based on the ultrasonic wave module, wherein the rotation critical point refers to a boundary point of the light outgoing surface of the display screen to which the ultrasonic wave module is capable of emitting the acoustic wave signal; a distance calculating submodule configured for calculating the distance from the rotation critical point to the initial position; a length and width obtaining submodule configured for obtaining the length and width of the light outgoing surface of the display screen according to a set algorithm, based on each of the distances and each of the rotation angles; a first plane coordinate obtaining submodule configured for obtaining a first plane coordinate of a perpendicular projection point of the microphone at the initial position on a plane where the light outgoing surface of the display screen is located, based on the length and width of the light outgoing surface of the display screen.

In the device of locating a microphone according to the embodiments of the present disclosure, by determining the initial position of the microphone in front of the light outgoing surface of the display screen, setting the target position of the microphone, determining the first displacement of the microphone in the direction perpendicular to the light outgoing surface of the display screen based on the target position and the initial position, determining the second displacement of the microphone in the direction parallel with the light outgoing surface of the display screen based on the target position and the initial position, and controlling the microphone to move to the target position based on the first and second displacements, the accuracy of the acoustic test result may be improved, the measurement errors may be reduced and manpower resource costs may be lowered.

Figure 4:
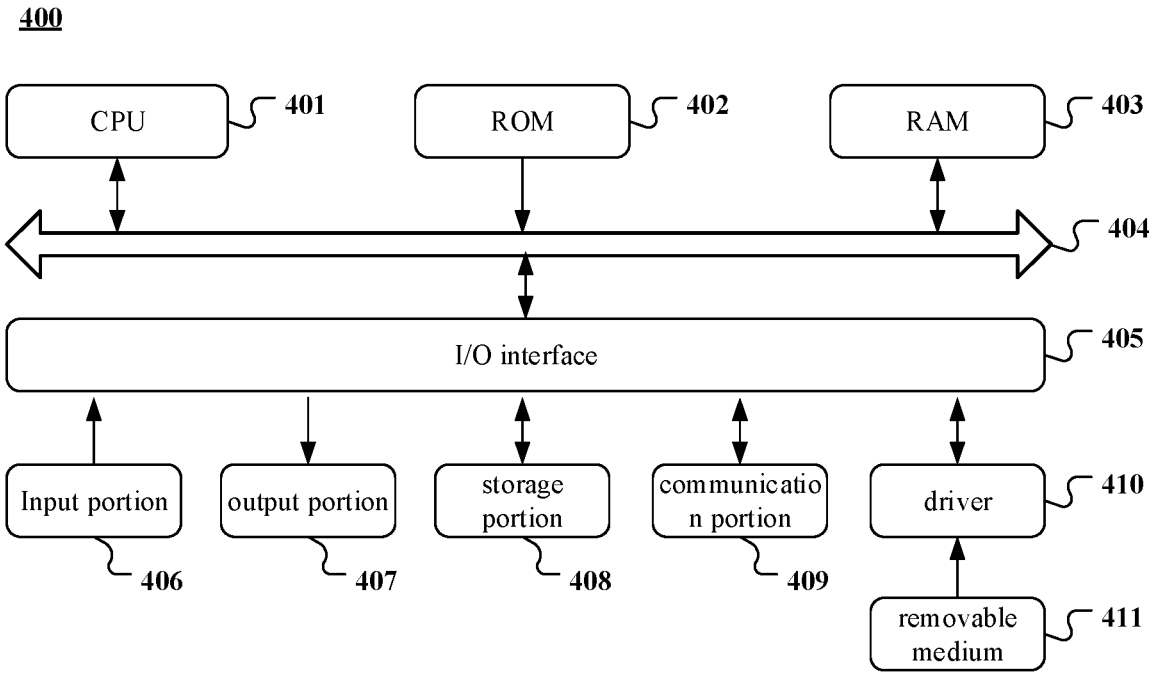
FIG. 4 is a schematic structural diagram of a computer system adapted to implement the method or the device of locating a microphone according to the embodiments of the present disclosure.

FIG. 4 is a schematic structural diagram of a computer system 400 adapted to implement a method of locating a microphone or a device of locating a microphone according to the embodiments of the present disclosure.

As shown in FIG. 4, the computer system 400 includes a central processing unit (CPU) 401, which may execute various appropriate actions and processes in accordance with a program stored in a read-only memory (ROM) 402 or a program loaded into a random access memory (RAM) 403 from a storage portion 408. The RAM 403 also stores various programs and data required by operations of the system 400. The CPU 401, the ROM 402 and the RAM 403 are connected to each other through a bus 404. An input/output (I/O) interface 405 is also connected to the bus 404.

The following components are connected to the I/O interface 405: an input portion 406 including a keyboard, a mouse, etc.; an output portion 407 comprising a cathode ray tube (CRT), a liquid crystal display device (LCD), a speaker, etc.; a storage portion 608 including a hard disk and the like; and a communication portion 409 comprising a network interface card, such as a LAN card and a modem. The communication portion 409 performs communication processes via a network, such as the Internet. A driver 410 is also connected to the I/O interface 405 as required. A driver 410 is also connected to the I/O interface 405 as required A removable medium 411, such as a magnetic disk, an optical disk, a magneto-optical disk, and a semiconductor memory, may be installed on the driver 410, to facilitate the retrieval of a computer program from the removable medium 411, and the installation thereof on the storage portion 408 as required.

In particular, according to an embodiment of the present disclosure, the process described above with reference to FIGS. 1 and 2 may be implemented in a computer software program. For example, an embodiment of the present disclosure includes a computer program product, which comprises a computer program that is tangibly embedded in a machine-readable medium. The computer program comprises program codes for executing the method of FIGS. 1 and 2. In such an embodiment, the computer program may be downloaded and installed from a network via the communication portion 409, and/or may be installed from the removable media 411.

The flowcharts and block diagrams in the drawings illustrate architectures, functions and operations that may be implemented according to the system, the method and the computer program product of the various embodiments of the present disclosure. In this regard, each block in the flow charts and block diagrams may represent a module, a program segment, or a code portion. The module, the program segment, or the code portion comprises one or more executable instructions for implementing the specified logical function. It should be noted that, in some alternative implementations, the functions denoted by the blocks may occur in a sequence different from the sequences shown in the drawings. For example, in practice, two blocks in succession may be executed, depending on the involved functionalities, substantially in parallel, or in a reverse sequence. It should also be noted that, each block in the block diagrams and/or the flow charts and/or a combination of the blocks may be implemented by a dedicated hardware-based system executing specific functions or operations, or by a combination of a dedicated hardware and computer instructions.

The units or modules involved in the embodiments of the present application may be implemented by way of software or hardware. The described units or modules may also be provided in a processor. For example, may be described as a processor, including an initial position determining module, a target position setting module, a first displacement determining module, a second displacement determining module and a target position moving module. The names of these units or modules are not considered as a limitation to the units or modules.

At least one embodiment of the present application further provides a computer storage medium. The computer storage medium may be the computer storage medium included in the apparatus in the above embodiments, or a stand-alone non-volatile computer storage medium which has not been assembled into the apparatus. The computer storage medium stores one or more programs. The one or more programs, when executed by one or more devices, cause the one or more devices to execute the method of locating a microphone according to the present application.

Figure 5:
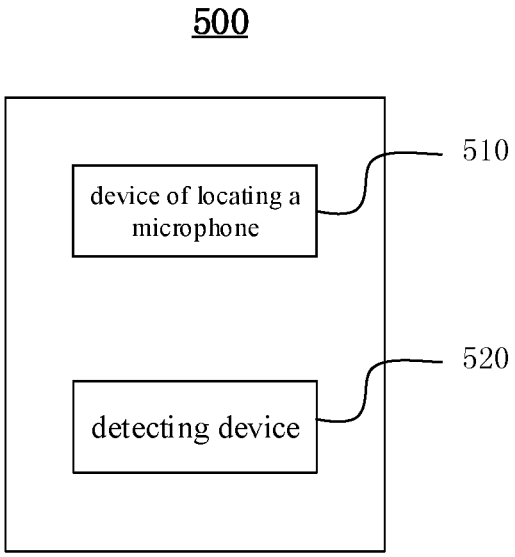
FIG. 5 is a schematic structural diagram of a system of locating a microphone according to at least one embodiment of the present disclosure.

At least one embodiment of the present disclosure further provides a system of locating a microphone, including any one of the above-mentioned devices of locating a microphone and a detecting devices, wherein the detecting device is configured to form a signal connection with the device of locating a microphone and to emit the detection signal to determine the first and second displacements. As shown in FIG. 5, the system 500 of locating a microphone according to at least one embodiment of the present disclosure includes a device 510 of locating a microphone and a detecting device 520, wherein the device 510 of locating a microphone may be any one of the above-mentioned devices of locating the microphone, and the detecting device 520 is configured to form a signal connection with the device 510 of locating a microphone and to emit the detection signal to determine the first and second displacements.

The embodiments of the present disclosure are described in a progressive manner, and each embodiment places emphasis on the difference from other embodiments. Therefore, the same part or similar part of various embodiments can mutually refer to each other.

Finally, it should also be noted that relationship terms such as "first" and "second" herein are merely used to distinguish one entity or operation from another entity or operation, and do not necessarily require or imply that there is an actual relationship or sequence between these entities or operations. Furthermore, terms "include", "comprise" or any other variations thereof are intended to cover a non-exclusive inclusion, so that a process, a method, an object or a device including a series of elements not only include the elements, but also include other elements not explicitly listed, or also include inherent elements of the process, the method, the object or the device. An element preceded by "comprises . . . a" does not, without more constraints, preclude the existence of additional identical elements in the process, method, article, or apparatus that comprises the element.

What are described above is related to the illustrative embodiments of the disclosure only and not limitative of the scope of the disclosure; the scope of the disclosure are defined by the accompanying claims.

What is claimed is:

1. A method of locating a microphone, comprising:

determining an initial position of the microphone located in front of a light outgoing surface of a display screen;

determining a target position of the microphone;

determining a first displacement of the microphone in a direction perpendicular to the light outgoing surface of the display screen based on the target position and the initial position;

determining a second displacement of the microphone in a direction parallel with the light outgoing surface of the display screen based on the target position and the initial position; and controlling the microphone to move to the target position based on the first displacement and the second displacement.

2. The method according to claim 1, wherein the first displacement comprises a first movement distance and a first movement direction, and the determining the first displacement of the microphone in the direction perpendicular to the light outgoing surface of the display screen based on the target position and the initial position comprises:

determining a first perpendicular distance from the microphone to the light outgoing surface of the display screen based on the initial position;

obtaining a second perpendicular distance from the target position to the light outgoing surface of the display screen; and determining the first movement distance and the first movement direction of the microphone based on the first perpendicular distance and the second perpendicular distance.

3. The method according to claim 2, wherein the determining the first perpendicular distance from the microphone to the light outgoing surface of the display screen based on the initial position comprises:

emitting a detection signal to the light outgoing surface of the display screen from the initial position, and recording a first time point when the detection signal is emitted;

obtaining a second time point when the detection signal reflected by the light outgoing surface of the display screen is received at the initial position; and determining the first perpendicular distance based on the first time point, the second time point and a propagation velocity of the detection signal.

4. The method according to claim 3, wherein the detection signal comprises at least one selected from a group consisting of an electromagnetic wave signal and an acoustic wave signal.

5. The method according to claim 4, wherein the emitting the detection signal to the light outgoing surface of the display screen from the initial position and recording the first time point when the detection signal is emitted comprises:

emitting an acoustic wave signal to the light outgoing surface of the display screen by using an ultrasonic wave module at the initial position, and recording the first time point when the acoustic wave signal is emitted, and the obtaining the second time point when the detection signal reflected by the light outgoing surface of the display screen is received at the initial position comprises:

obtaining the second time point when the acoustic wave signal reflected by the light outgoing surface of the display screen is received by the ultrasonic wave module.

6. The method according to claim 1, wherein the second displacement comprises a second movement distance and a second movement direction, and the determining the second displacement of the microphone in the direction parallel with the light outgoing surface of the display screen based on the target position and the initial position comprises:

obtaining a first plane coordinate of a perpendicular projection point of the microphone at the initial position on a plane parallel with the light outgoing surface of the display screen;

obtaining a second plane coordinate of a perpendicular projection point of the microphone at the target position on the plane parallel with the light outgoing surface of the display screen; and determining the second movement distance and the second movement direction of the microphone based on the first plane coordinate and the second plane coordinate.

7. The method according to claim 6, wherein the plane parallel with the light outgoing surface of the display screen comprises a plane where the light outgoing surface of the display screen is located.

8. The method according to claim 6, wherein the obtaining the first plane coordinate of the perpendicular projection point of the microphone at the initial position on the plane parallel with the light outgoing surface of the display screen comprises:

determining distances from the initial position to at least two adjacent edges of the light outgoing surface of the display screen; and determining the first plane coordinate of the perpendicular projection point of the microphone at the initial position on the plane parallel with the light outgoing surface of the display screen based on the distances from the initial position to at least two adjacent edges of the light outgoing surface of the display screen.

9. The method according to claim 8, wherein the microphone is configured to be provided with an ultrasonic wave module, and the microphone is configured to be on a rotation device, the determining the distances from the initial position to the at least two adjacent edges of the light outgoing surface of the display screen comprises:

rotating the microphone in a plurality of directions from a plane where the initial position is located by using the rotation device, and recording a rotation angle;

determining a rotation critical point corresponding to each of the plurality of directions based on the ultrasonic wave module, wherein the rotation critical point is a boundary point of the light outgoing surface of the display screen to which the ultrasonic wave module emits is capable of emitting an acoustic wave signal; and calculating the distance from the rotation critical point to the initial position, and the determining the first plane coordinate of the perpendicular projection point of the microphone at the initial position on the plane parallel with the light outgoing surface of the display screen based on the distances from the initial position to the at least two adjacent edges of the light outgoing surface of the display screen comprises:

obtaining a length and a width of the light outgoing surface of the display screen according to a set algorithm, based on the distance from the rotation critical point to the initial position and the rotation angle; and obtaining the first plane coordinate of the perpendicular projection point of the microphone at the initial position on a plane where the light outgoing surface of the display screen is located, based on the length and the width of the light outgoing surface of the display screen.

10. A device of locating a microphone, comprising:

an initial position determining module, configured for determining an initial position of the microphone located in front of a light outgoing surface of a display screen;

a target position setting module, configured for determining a target position of the microphone;

a first displacement determining module, configured for determining a first displacement of the microphone in a direction perpendicular to the light outgoing surface of the display screen based on the target position and the initial position;

a second displacement determining module, configured for determining a second displacement of the microphone in a direction parallel with the light outgoing surface of the display screen based on the target position and the initial position; and a target position moving module, configured for controlling the microphone to move to the target position based on the first displacement and second displacement.

11. The device according to claim 10, wherein the first displacement comprises a first movement distance and a first movement direction, and the first displacement determining module comprises:

a perpendicular distance determining submodule, configured for determining a first perpendicular distance from the microphone to the light outgoing surface of the display screen based on the initial position;

a perpendicular distance obtaining submodule, configured for obtaining a second perpendicular distance from the target position to the light outgoing surface of the display screen; and a movement distance and direction determining submodule, configured for determining the first movement distance and the first movement direction of the microphone based on the first perpendicular distance and the second perpendicular distance.

12. The device according to claim 11, wherein the perpendicular distance determining submodule comprises:

a first time point recording submodule, configured for recording a first time point when the detection signal is emitted to the light outgoing surface of the display device from the initial position;

a second time point obtaining submodule, configured for obtaining a second time point when the detection signal reflected by the light outgoing surface of the display screen is received at the initial position; and a first perpendicular distance determining submodule, configured for determining the first perpendicular distance based on the first time point, the second time point and a propagation velocity of the acoustic wave signal.

13. The device according to claim 12, wherein the detection signal comprises at least one selected from a group consisting of an electromagnetic wave signal and an acoustic wave signal.

14. The device according to claim 10, wherein the second displacement comprises a second movement distance and a second movement direction, and the second displacement determining module comprises:

a first plane coordinate obtaining submodule, configured for obtaining a first plane coordinate of a perpendicular projection point of the microphone at the initial position on a plane parallel with the light outgoing surface of the display screen;

a second plane coordinate obtaining submodule, configured for obtaining a second plane coordinate of a point of the microphone at the target position on the plane parallel with the light outgoing surface of the display screen;

a second movement distance and direction determining submodule, configured for determining the second movement distance and the second movement direction of the microphone based on the first plane coordinate and the second plane coordinate.

15. The device according to claim 14, wherein the plane parallel with the light outgoing surface of the display screen comprises a plane where the light outgoing surface of the display screen is located.

16. The device according to claim 14, wherein the first plane coordinate obtaining submodule is configured to:

determine distances from the initial position to at least two adjacent edges of the light outgoing surface of the display screen; and determine the first plane coordinate of the perpendicular projection point of the microphone at the initial position on the plane parallel with the light outgoing surface of the display screen based on the distances from the initial position to at least two adjacent edges of the light outgoing surface of the display screen.

17. The device according to claim 14, wherein the microphone is configured to be provided thereon with an ultrasonic wave module, and the microphone is configured to be arranged on a rotation device, the first plane coordinate obtaining submodule comprises:

a rotation angle recording submodule, configured for rotating the microphone in a plurality of directions from a plane where the initial position is located by using the rotation device, and recording a rotation angle;

a rotation critical point determining submodule, configured for determining a rotation critical point corresponding to each of the plurality of directions based on the ultrasonic wave module, wherein the rotation critical point is a boundary point of the light outgoing surface of the display screen to which the ultrasonic wave module is capable of emitting an acoustic wave signal;

a distance calculating submodule, configured for calculating the distance from the rotation critical point to the initial position;

a length and width obtaining submodule, configured for obtaining a length and a width of the light outgoing surface of the display screen according to a set algorithm, based on the distance from the rotation critical point to the initial position and the rotation angle; and a first plane coordinate obtaining submodule, configured for obtaining a first plane coordinate of a perpendicular projection point of the microphone at the initial position on a plane where the light outgoing surface of the display screen is located, based on the length and the width of the light outgoing surface of the display screen.

18. A system of locating a microphone, comprising the device of locating a microphone according to claim 12 and a detecting device, wherein the detecting device is configured to form a signal connection with the device of locating the microphone and emit the detection signal.

19. A device of locating a microphone, comprising:

a processor; and a storage, storing a computer program instruction which, when executed, causes the processor to execute following operations:

determining an initial position of the microphone located in front of a light outgoing surface of a display screen;

determining a target position of the microphone;

determining a first displacement of the microphone in a direction perpendicular to the light outgoing surface of the display screen based on the target position and the initial position;

determining a second displacement of the microphone in a direction parallel with the light outgoing surface of the display screen based on the target position and the initial position; and controlling the microphone to move to the target position based on the first displacement and the second displacement.

20. A system of locating a microphone, comprising the device of locating a microphone according to claim 19 and a detecting device, wherein the detecting device is configured to be form a signal connection with the device of locating the microphone and emit the detection signal to determine the first displacement and the second displacement.

* * * * *